US005645103A

United States Patent [19]

Whittaker

[11] Patent Number: 5,645,103

[45] Date of Patent: Jul. 8, 1997

[54] WATER HEATER STAND WITH OVERFLOW CATCH BASIN

[76] Inventor: David S. Whittaker, R.R. #3, Box 8, New Era Village, Belington, W. Va. 26250

[21] Appl. No.: 617,119

[22] Filed: Mar. 18, 1996

[51] Int. Cl.[6] ..... F24H 9/06; F24H 9/16

[52] U.S. Cl. ..... 137/312; 137/315; 137/362; 220/571; 222/108; 248/146; 248/346.01

[58] Field of Search ..... 137/312, 314, 137/315, 357, 360, 362; 4/251.1, 251.2, 613, 614; 220/571, 572, DIG. 6; 222/108; 248/346.01, 346.02, 127, 146; 122/504, 510; 73/46, 49.2

[56] References Cited

U.S. PATENT DOCUMENTS

| | | | |
|---|---|---|---|
| 175,835 | 4/1876 | Keyser | 4/251.1 |
| 475,149 | 5/1892 | Pearson | 4/251.1 |
| 3,069,671 | 12/1962 | Taylor | 122/504 |
| 3,304,950 | 2/1967 | Hubert | 137/312 |
| 3,519,233 | 7/1970 | Logsdon | 248/146 |
| 3,800,335 | 4/1974 | Buonaura | 4/613 |
| 3,895,398 | 7/1975 | Mustee | 4/613 |
| 4,765,360 | 8/1988 | Baird | 137/312 |
| 4,903,723 | 2/1990 | Sublett | 4/251.1 |
| 4,944,253 | 7/1990 | Bellofatto | 122/507 |
| 5,085,205 | 2/1992 | Hall et al. | 122/504 |
| 5,099,873 | 3/1992 | Sanchez | 137/312 |
| 5,134,683 | 7/1992 | Powell | 122/504 |
| 5,224,508 | 7/1993 | Bates, Jr. | 137/312 |
| 5,285,989 | 2/1994 | Zilbert et al. | 248/146 |
| 5,368,263 | 11/1994 | Harrison | 248/146 |
| 5,437,303 | 8/1995 | Johnson | 4/613 |
| 5,452,739 | 9/1995 | Mustee et al. | 4/251.1 |

*Primary Examiner*—George L. Walton
*Attorney, Agent, or Firm*—John Gugliotta; David L. Volk

[57] ABSTRACT

A water heater stand with overflow catch basin having a flat, horizontally elongated stand member having a generally round shape and surrounded by a continuous vertical wall circumscribing the perimeter. A drain is provided, as well as a plurality of elevated support members, each said support member formed integral to said bottom surface and extending upward. Drainage channels are formed between adjacent support members, and a curved, laterally extended area projecting outward accommodates the tank drainage valve of a hot water heater tank. Additionally, a vertically extended splash guard attachable in order to extend the vertical height of the sidewalls.

6 Claims, 2 Drawing Sheets

WATER HEATER STAND WITH OVERFLOW CATCH BASIN

BACKGROUND OF THE INVENTION

1. Field of the Invention

The present invention relates generally to appliance stands and catch basins and, more particularly, to a water heater stand with integrated overflow catch basin and drainage system.

2. Description of the Related Art

In the related art, stands for household appliances such as water heaters are known. For example, in U.S. Pat. No. 5,368,263, issued in the name of Harrison, a water heater stand is disclosed which is height adjustable, and includes a drainage system. Another example is disclosed in U.S. Pat. No. 3,519,233, issued in the name of Logsdon, wherein an elevated sheet-metal drain pan is shown.

However, a water heater stand made in accordance with this reference is associated with several drawbacks. For example, although crude drain systems are generally utilized, all such systems are for use in elevating a water heater a distance above a floor or other surface, and cannot be used for existing water heaters which are placed directly upon a floor or other surface. Moreover, none are made of recycled or recyclable plastic, nor are any designed to prevent flooding during the draining of a water heater. Also, adjustable splash guards have not been available for use with such devices in order to prevent splashing and over spray during either catastrophic failure or routine draining of a water heater.

Consequently, a need has been felt for providing an apparatus and method which overcomes such problems in a simple, easy to manufacture, and easy to install device which can be used with any type of water heater.

SUMMARY OF THE INVENTION

It is therefore an object of the present invention to provide an improved water heater stand with integrated catch basin.

It is a feature of the present invention to provide an improved drainage pan to be placed under water heaters to protect against water heater leak, sweat and rupture, or merely to make draining a water heater easier, thereby preventing property damage to homes, including floors, carpets, walls and paneling.

Briefly described according to one embodiment of the present invention, a water heater stand with overflow catch basin is provided which can be molded out of plastic in one piece, thereby eliminating rust and rot. A high perimeter wall prevents splashing while draining water heaters when it is in position. A curved area which extends out of the perimeter of the tank is positioned to accommodate the tank drainage valve. An adapter accommodates a gas or fuel oil water heater, and an extra splash guard can be clipped to the front wall. If hooked into a sewer system, a J-trap is necessary to prevent sewer odor from coming into the home. If not connected to a home's sewer, a screen is placed into it to prevent rodents from entering the home.

Routine drainage of water heaters is known to prolong the life of the water heater. An advantage of the present invention is that such routine drainage is made easier.

Another advantage of the present invention is that water is collected and channeled under the floor of a home, thereby eliminating water damage from accidents.

Further, the present invention can be used for existing water heaters which are placed directly upon a floor or other surface, can be made of recycled or recyclable plastic, and can include adjustable splash guards to accommodate various types of water heaters.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
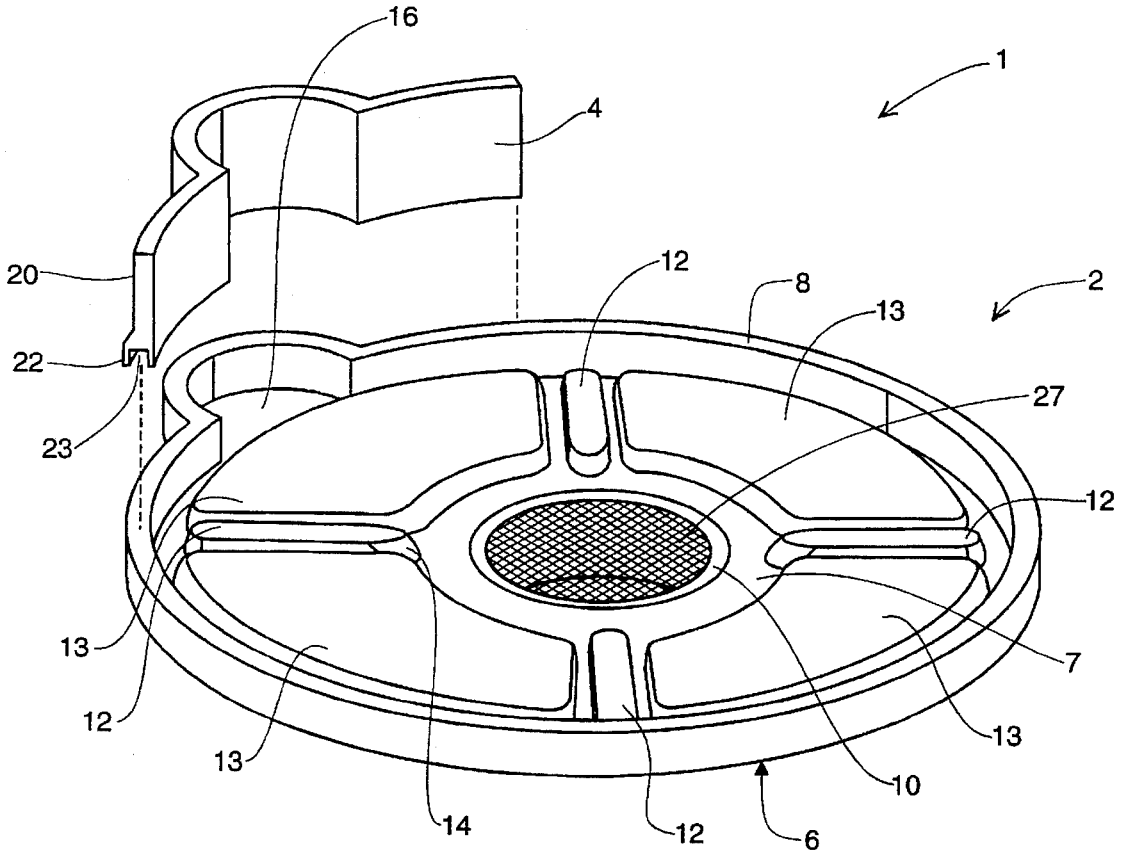
FIG. 1 is a perspective view of a water heater stand with overflow catch basin according to the preferred embodiment of the present invention.

Referring now to FIG. 1, a water heater stand with overflow catch basin, generally noted as 1 is shown, according to the present invention, having a horizontally elongated stand member 2 and a detachable, vertically extended splash guard 4. Although many materials of construction are envisioned, it is felt that additional benefits, including ease of manufacture and recyclability, can be achieved utilizing injection molded plastic material. Therefore, a unitary piece of injection molded plastic material is the preferred design for the stand member 2. The stand member 2 is generally round in shape, and has a flat bottom surface 6 surrounded by a high wall 8 circumscribing the perimeter. The wall 8 is continuous about the perimeter, thereby forming a water retainable dike-like area within the wall 8. A center drain 10 is formed flush with a floor surface 7, and a plurality of elevated support members 12 are formed integral to the floor surface 7 but extending upward. The floor surface 7 tapers slightly downward from the wall 8, radially inward toward the drain 10 to facilitate drainage. The support members 12 form drainage channels 14 between each other. A number of adapter plates 13 are provided for adapting the present invention for use with gas and fuel oil water heaters in order to aid in the leveling of the water heaters. Additionally, a curved, laterally extended area 16 projects outward of the perimeter of the stand member 2. In use, the water heater is positioned with the outer heater drain outlet above the extended area 16.

The vertically extended splash guard 4 is shown having an upward wall member 20 atop a receiving notch 22. The receiving notch 22 is formed by a pair of fork-like retaining ears 23. The high wall 8 circumscribing the perimeter of the stand member 2 is received within and contained by the receiving notch 22 in a clip-on fashion. It is envisioned that the splash guard 4 can be used to extend the wall 8 upward at the location where the water heater drain valve is located, thereby forming a retainable dike-like area for preventing the discharge of drained fluids from the drain valve from splashing outside of the water heater stand onto a building floor surface 9.

Figure 2:
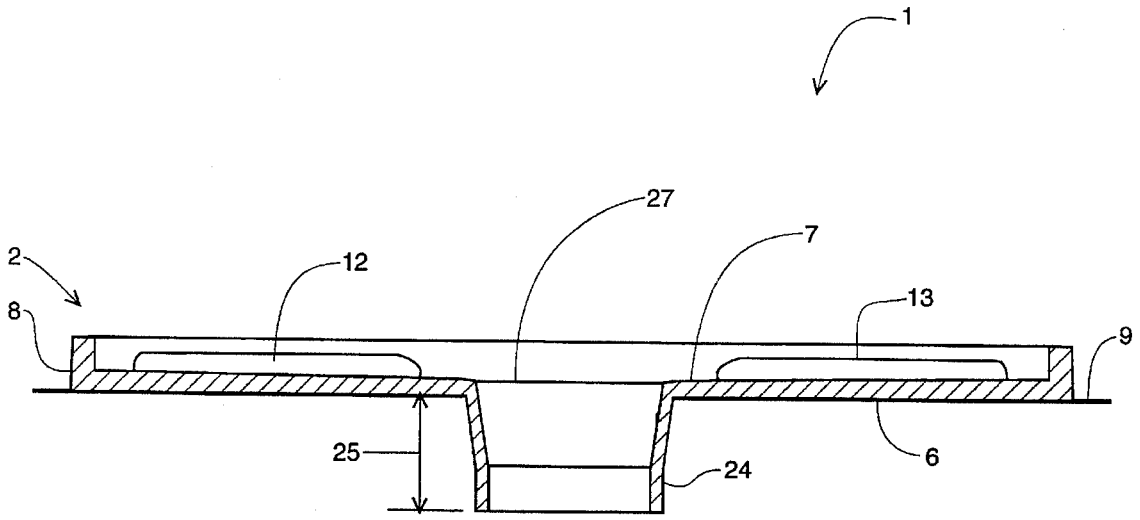
FIG. 2 is a is a cross sectional side view thereof.

Referring to FIG. 2, the water heater stand with overflow catch basin, generally noted as 1, is shown in a cross sectional side elevation. The stand member 2 is shown installed with the bottom surface 6 flush against the building floor surface 9. The center drain 10 is again shown formed flush with the floor surface 7, with a discharge nozzle 24 extending a distance 25 beneath the flat bottom surface 6. It is envisioned that the discharge nozzle 24 can be hooked into a sewer system; if so, a J-trap is necessary to prevent sewer odor from coming into the home. If not connected to a home's sewer, a screen 27 formed directly over the center drain 10 to prevent rodents from entering the home.

The plurality of elevated support members 12 and the adapter plates 13 are better shown having a flat top surface at an equal elevation to each other, and below the upper height of the wall 8. In use, the stand member 2 is installed with its bottom surface 6 flush against the building floor surface 9. A water heater is placed on the stand member 2. The water heater should be positioned so that the water heater drain outlet is above the extended area 16. If the water heater has a flat bottom, as is generally the case for electric water heaters, the bottom of the water heater will rest on the support members 12, and the adapter plates 13 are not necessary. If the water heater has legs, as is generally the case for gas and fuel-oil fired water heaters, the adapter plates 13 may be necessary to ensure that each leg of the water heater is resting on either one of the adapter plates 13 or one of the support members 12, and is thus level. If water drains from the water heater because of leakage, or because the water heater drain valve is opened, water will be caught by the stand member 2 and will flow along the channels 14 to the drain 10.

The foregoing description is included to illustrate the operation of the preferred embodiment and is not meant to limit the scope of the invention. One skilled in the appropriate art would recognize many minor variations that can be made in accordance with the teachings and scope of the present disclosure. Therefore, the scope of the invention is to be limited only by the following claims.

What is claimed is:

1. A water heater stand comprising:

a stand member having a floor surface, the floor surface bounded by a continuous wall disposed along a perimeter of the floor surface;

a drain in the floor surface;

a plurality of elevated support members extending upward from the floor surface, all of the elevated support members having an upper surface at an equal elevation to one another and below a top edge of the wall;

a plurality of drainage channels formed between the support members; and a vertically extended splash guard removably attachable to at least a portion of the stand member adjacent a water heater drain valve, thereby forming a retainable dike-like area for preventing a discharge of fluids from the drain valve from splashing outside of the water heater stand.

2. The water heater stand of claim 1, wherein the splash guard comprises:

a receiving notch for receiving the top edge of the wall, the receiving notch formed by a pair of fork-like retaining ears; and an upward wall member atop the receiving notch.

3. The water heater stand of claim 1, further comprising a discharge nozzle in fluid communication with the drain and extending beneath the floor surface.

4. The water heater stand of claim 1, further including a lateral extension of the floor surface for positioning below the water heater valve.

5. The water heater stand of claim 4, wherein the splash guard is configured to surround the extension.

6. The water heater stand of claim 1, further comprising at least one adapter plate being equal in height with the support members and having a top surface area which is larger than the area of the upper surface of each of the support members, the adapter plate extending upward from the floor surface and positioned between two of the support members.

* * * * *